US007235932B2

(12) United States Patent
Crandall et al.

(10) Patent No.: US 7,235,932 B2
(45) Date of Patent: Jun. 26, 2007

(54) HIGH EFFICIENCY BALLAST FOR GAS DISCHARGE LAMPS

(75) Inventors: Earl F. Crandall, Raleigh, NC (US); Ray King, Carlonia Beach, NC (US)

(73) Assignee: PureSpectrum, Inc., Savannah, GA (US)

( * ) Notice: Subject to any disclaimer, the term of this patent is extended or adjusted under 35 U.S.C. 154(b) by 129 days.

(21) Appl. No.: 10/903,461

(22) Filed: Jul. 30, 2004

(65) Prior Publication Data

US 2005/0110428 A1 May 26, 2005

Related U.S. Application Data

(60) Provisional application No. 60/491,793, filed on Aug. 1, 2003.

(51) Int. Cl.
*H05B 41/16* (2006.01)

(52) U.S. Cl. ..... 315/279; 315/291; 315/307; 315/274; 315/282

(58) Field of Classification Search ..... 315/291, 315/307, 224, 225, 279, 274, 282; 361/21.08, 361/21.09, 21.1, 21.11, 21.07, 21.04
See application file for complete search history.

(56) References Cited

U.S. PATENT DOCUMENTS 6,370,039 B1 * 4/2002 Telefus ..... 363/15
6,445,599 B1 * 9/2002 Nguyen ..... 363/25
6,765,808 B1 * 7/2004 Jin et al. ..... 363/16
6,813,170 B2 * 11/2004 Yang ..... 363/56.09
6,900,599 B2 * 5/2005 Ribarich ..... 315/247
6,963,176 B2 * 11/2005 Onishi et al. ..... 315/291
2004/0032223 A1 * 2/2004 Henry ..... 315/291

* cited by examiner

*Primary Examiner*—Tuyet Thi Vo
(74) *Attorney, Agent, or Firm*—Roylance, Abrams, Berdo & Goodman, L.L.P.

(57) ABSTRACT

An electronic ballast for a gas discharge lamp includes an adjustable constant current source circuit adapted to convert a direct current input to provide an initial start current and a variably controlled constant current. A coupling transformer circuit is connected to the adjustable constant current source and adapted to couple the initial start current to the gas discharge lamp to provide a corresponding start voltage approximately equal to a strike voltage of the gas discharge lamp and to convert the variably controlled constant current to a square wave current to power the gas discharge lamp thereafter. A current sense circuit is adapted to sense an operating current at the coupling transformer and to provide corresponding current sense information to the adjustable constant current source, wherein said current sense information is used to vary the variably controlled constant current.

18 Claims, 5 Drawing Sheets

HIGH EFFICIENCY BALLAST FOR GAS DISCHARGE LAMPS

RELATED APPLICATIONS

This application claims the benefit of U.S. Provisional Application No. 60/491,793, filed Aug. 1, 2003, which is incorporated by reference.

BACKGROUND

The invention relates to electronic ballasts for gas discharge lamps. More specifically, the invention relates to a high efficiency electronic ballast that adjustably controls current.

Fluorescent light operates by creating a discharge or arc across an ionized gas within a glass tube. In traditional fluorescent lighting, the gas tube is filled with mercury vapor which, when ionized, collides with electrons from a current flow induced between the electrodes of a lamp, causing the emission of photons. These photons strike fluorescent material on the inner wall of the glass tube and produce visible light.

Fluorescent and other gas discharge lamps require a ballast to operate. The ballast conditions the electric power to produce the input characteristics needed for the lamp. When arcing, the lamp exhibits a negative resistance characteristic, and therefore needs some control to avoid a cascading discharge. Both manufacturers and the American National Standards Institute specify lamp characteristics, which include current, voltage, and starting conditions. Historically, 50–60 Hz ballasts relied on a heavy core of magnetic material; today, most modern ballasts are electronic.

Electronic ballasts can include a starting circuit and may or may not require heating of the lamp electrodes for starting or igniting the lamp. Prior to ignition, a lamp acts as an open circuit; when an arc is created the lamp starts, the entire ballast starting voltage is applied to the lamp. After ignition, the current through the lamp increases until the lamp voltage reaches equilibrium based on the ballast circuit. Ballasts can also have additional circuitry designed to filter electromagnetic interference (EMI), correct power factor errors for alternating current power sources, filter noise, etc.

Electronic ballasts typically use a rectifier and an oscillating circuit to create a pulsed flow of electricity to the lamp. Common electronic lighting ballasts convert 60 Hz line or input current into a direct current, and then back to a square wave alternating current to operate the lamps. Some lighting ballasts further convert the square wave to more of a sine wave, typically through an LC resonant lamp network to smooth out the pulses to create sinusoidal waveforms for the lamp. See, for example, U.S. Pat. No. 3,681,654 to Quinn, or U.S. Pat. No. 5,615,093 to Nalbant.

The square wave approach is common for a number of reasons. Many discrete or saturated switches are better suited to the production of a square wave than a sinusoidal wave. In lower frequency applications, a square wave provides more consistent lighting; a normal sinusoid at low frequency de-ionizes the gas as the voltage cycles below the discharge level, which then requires additional energy to re-ionize the lamp. A square wave provides a number of other features, such as constant instantaneous lamp power, and favorable crest factors. With a square wave, current density in the lamp is generally stable, promoting long lamp life; similarly, there is little temperature fluctuation, which avoids flicker and discharge, damaging the lamp.

It is known that higher frequencies can produce more efficient lighting. In general, if de-ionization is minimized or avoided, then less energy is needed because there is no re-ionization of the gas; that is, a higher frequency avoids the cycle of decay and recovery of ionization within the lamp. Further, the anode fall voltage can be lower when the frequency is higher than the oscillation frequency of the plasma.

However, higher frequency ballasts suffer some problems. First, electronic ballasts can create harmonic disturbance, due in part to the use of pulses or square wave signals. Harmonics are signals in which the frequency is a whole number multiple of the system's fundamental frequency; the third harmonic is most damaging. The total harmonic distortion (or "THD") is one measure of ballast performance. Harmonics create unexpected or nonlinear loading of circuit elements; the harmonic signals cause voltage drops at points of impedance, at the frequency of the harmonic current. At high frequency, the circuitry required to convert a square wave into a sinusoidal wave may limit the available frequency of operation; high frequency voltage drops can change the voltage values of the fundamental wave. A ballast with a high THD may also create electromagnetic interference with nearby electrical equipment, necessitating additional circuitry to filter harmonics; however, such circuits can introduce additional problems such as high inrush current. Second, as discussed in U.S. Pat. No. 5,173,643 to Takehara, it is generally believed that operating frequencies above 50 KHz may introduce stray capacitance into lamp circuitry. Finally, the semiconductor switches of many oscillating circuits in electronic ballasts have faced inefficiency or losses, including thermal dissipation, at high frequency driving. Thus, ballast technology has heretofore been limited, thereby also limiting the opportunity for improved energy efficiency.

SUMMARY

It should be emphasized that the terms "comprises" and "comprising", when used in this description and claims, are taken to specify the presence of stated features, steps, or components, but the use of these terms does not preclude the presence or addition of one or more other features, steps, components, or groups thereof.

In one aspect of the invention, an electronic ballast for a gas discharge lamp includes an adjustable constant current source circuit adapted to convert a direct current input to provide an initial start current and a variably controlled constant current. A coupling transformer circuit is connected to the adjustable constant current source and adapted to couple the initial start current to the gas discharge lamp to provide a corresponding start voltage approximately equal to a strike voltage of the gas discharge lamp and to convert the variably controlled constant current to a square wave current to power the gas discharge lamp thereafter. A current sense circuit is adapted to sense an operating current at the coupling transformer and to provide corresponding current sense information to the adjustable constant current source, wherein said current sense information is used to vary the variably controlled constant current.

BRIEF DESCRIPTION OF THE DRAWINGS

Objects and advantages of the present invention will become apparent to those skilled in the art upon reading this description in conjunction with the accompanying drawings, in which like reference numerals have been used to designate like elements, and in which.

DETAILED DESCRIPTION

Figure 1:
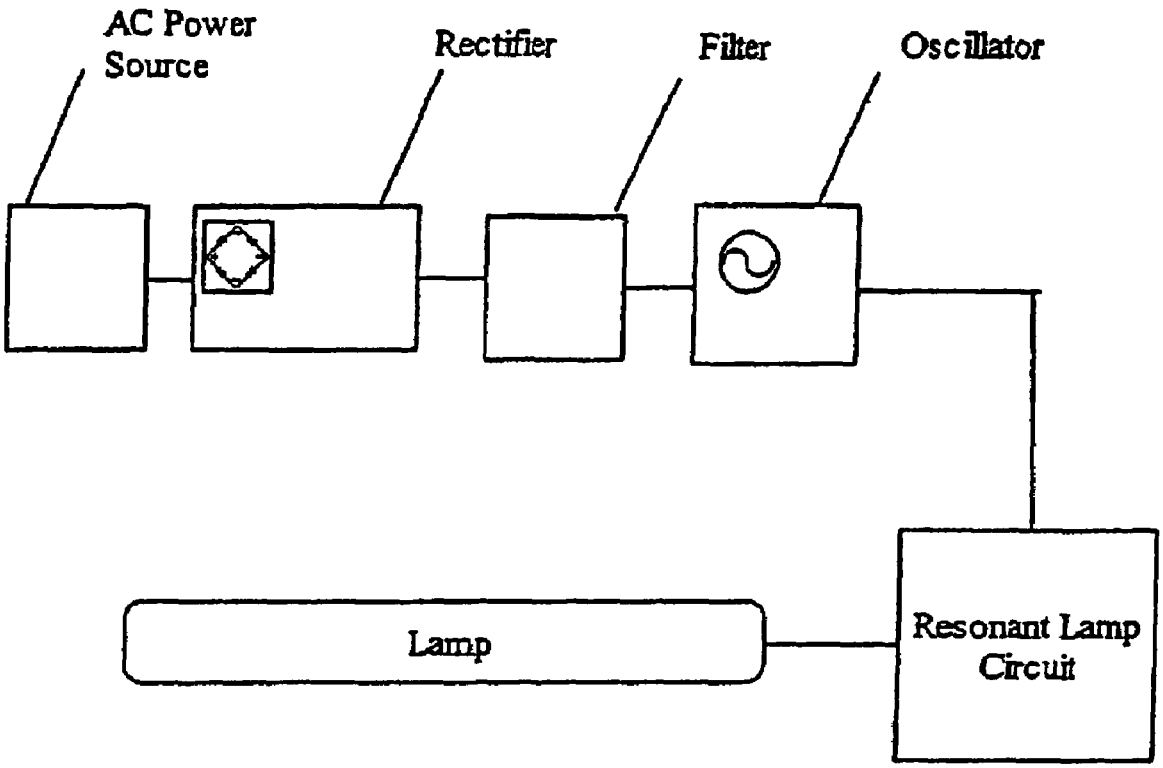
PRIOR ART FIG. 1
FIG. 1 is a block diagram illustrating a conventional electronic ballast.

FIG. 1 shows a basic block diagram illustrating a conventional approach to electronic ballasts; a rectifier converts an alternating current source into direct current, which is filtered and then passes to an oscillator to generate a square wave. A lamp network is required to condition the square wave for the lamp; this conditioning includes treatment of the wave as described above, such as filtering harmonic distortion and noise, and possibly modifying the square wave form to create more of a sinusoidal shape—if desired for the application.

Figure 2:
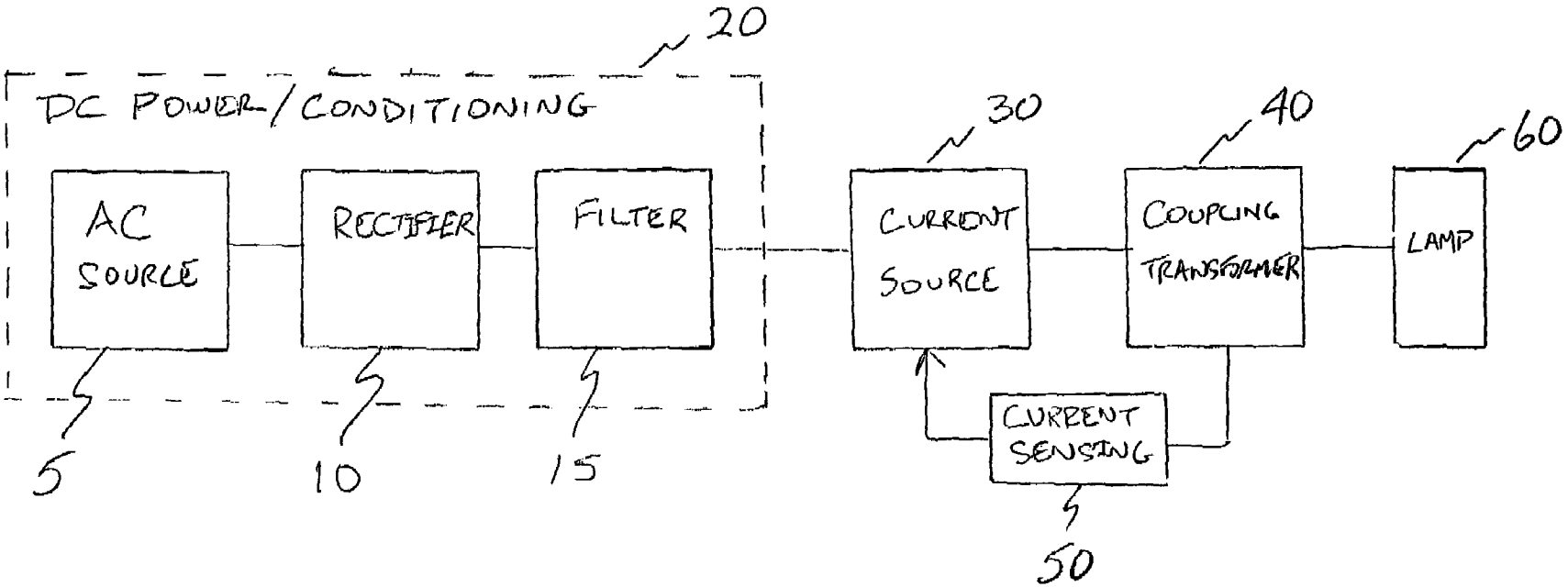
FIG. 2 is a block diagram illustrating an electronic ballast according to an aspect of the invention.

FIG. 2 is a basic block diagram of the configuration of an embodiment of the present invention. A direct current (DC) power/conditioning block 20 supplies DC power to the current source 30. The DC power/conditioning block 20 contains all of the input conditioning needed to condition and convert power from an alternating current (AC) power source 5. A rectifier 10 converts the AC input into DC. The rectifier 10 may be one of any number of designs known in the art and capable of producing DC from AC. The DC is then filtered by a filter 15 to remove AC ripple. An L-C or Pi filter, or their equivalents, may be employed. The DC power/conditioning block 20 may further include fusing and power factor correction. The power factor correction circuitry, when employed, may be either a buck or a boost type design. It should also be understood that this invention is not limited to AC sources of input power; the rectifier 10 and filter 15 may be omitted for applications involving a DC input, or replaced with a single diode or other such components appropriate for providing a DC input.

A current source circuit 30 receives the filtered DC and variably controls the application of the current to a coupling transformer circuit 40. The coupling transformer 40 converts the variably controlled DC into a square wave constant current, which is supplied to the gas discharge lamp 60. The current at the primary windings of the coupling transformer 50 is sensed by current sensing block 50. This current sensing block 50 provides current sense information back to the current source 30 to control the application of the current to the coupling transformer 40 in order to maintain a constant current, and a constant power, in the lamp, as discussed further below.

Figure 3:
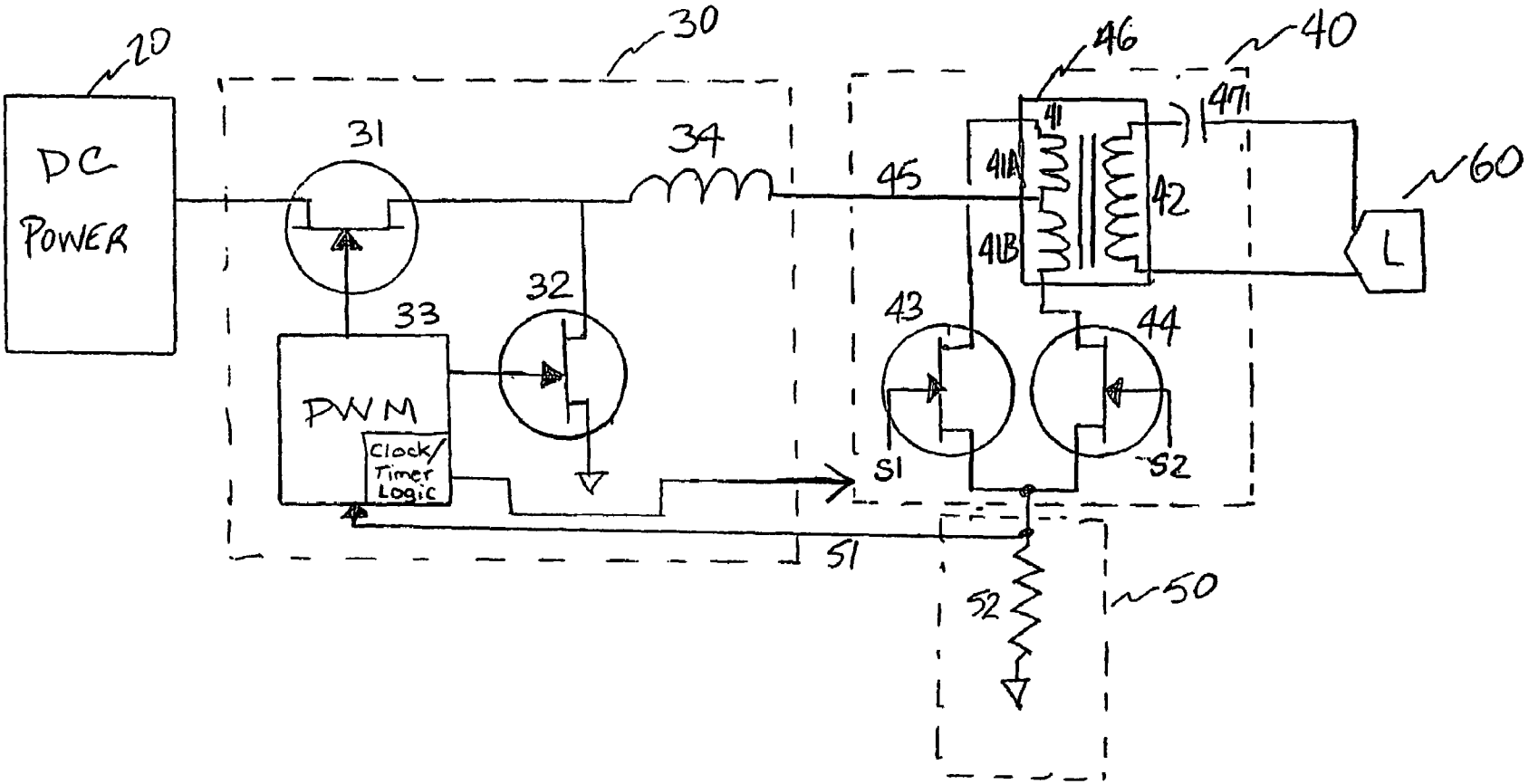
FIGS. 3 and 3A are detailed block diagrams illustrating alternative embodiments of an electronic ballast in accordance with the present invention.
Figure 3A:
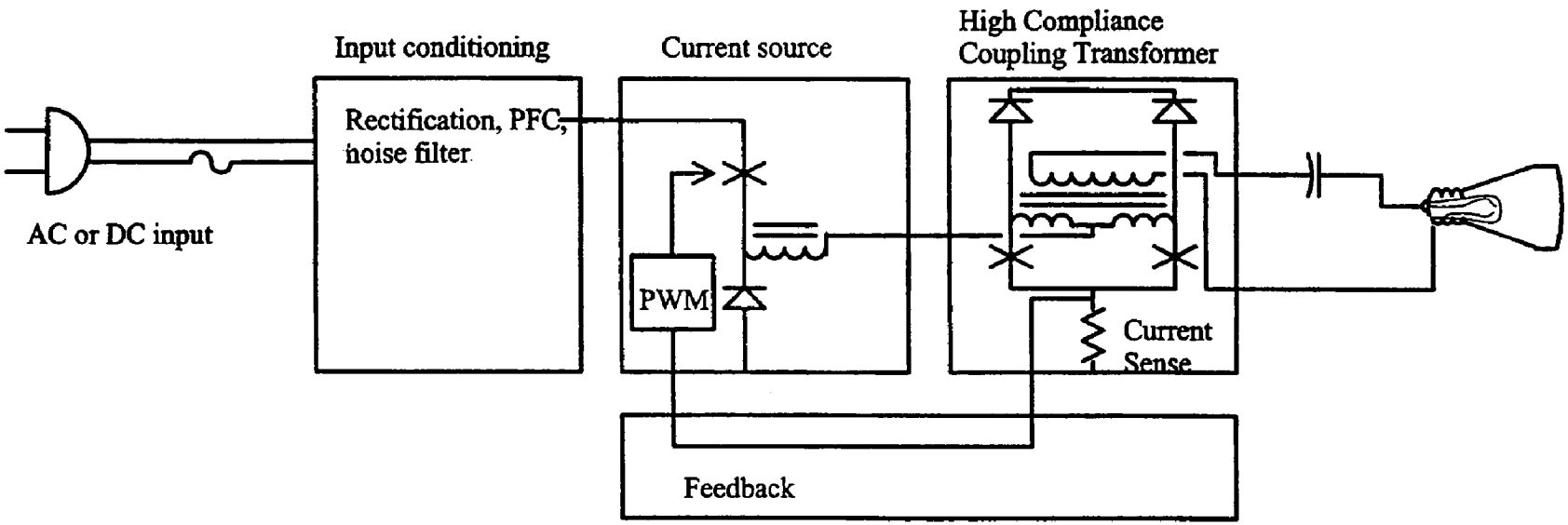

FIG. 3 shows in greater detail a general embodiment of the present invention. DC power is provided by the DC power/conditioning block 20, or alternatively, any DC power that is substantially free from AC ripple may be used. The DC power is supplied to an inductor 34 through a current switch 31, which is operated to control, i.e., adjust, the amount of current to the inductor 34 under the control of a pulse-width modulator (PWM) 33. The inductor 34 acts to limit the change in current, i.e., as a choke. A discharge switch 32 is operated by the PWM 33 to discharge any superfluous current to ground. Together, the current switch 31, discharge switch 32, PWM 33, and inductor 34 are arranged as a two-switch constant-current synchronous buck regulator with the output fed through a choke to limit the rate of change of current. Alternatively, other devices known in the art may be used in place of the discharge switch 32, such as a diode, which can be arranged to discharge any superfluous current to ground.

The output of the inductor 34 is applied to the center tap 45 of primary winding 41 of the coupling transformer 46. That is, the center tap 45 splits the primary winding 41 of transformer 46 into a first portion 41A and a second portion 41B. Two power switches 43 and 44 connect the first portion 41A and a second portion 41B of the primary winding, respectively, to ground through a low value current sense resistor 52, e.g., 0.1 ohm. That is, each end of primary winding 41 connects to ground through a respective one of power switches 43 and 44. There are many known power switches that may be employed, such as MOSFET, JFET, IGBT, bipolar transistors, GTO, and the like. Moreover, a current sensing transformer may be employed in place of the current sense resistor 52.

The power switches 43 and 44 operate under the control of signals S1 and S2, respectively, to produce a square wave at the primary winding 41, which is coupled to the secondary winding 42 and output to the lamp 60. The voltage difference between the square wave signals at the primary winding 41 and the secondary winding 42 are dependent on the turns-ratio of the transformer 46. The no load voltage impressed on the secondary winding 42 of transformer 40 is preferably approximately equal to the strike voltage of the lamp 60. The power switches 43 and 44 are controlled via signals S1 and S2, and may operate synchronously with the buck regulator in the current source block 30. For example, the PWM 33 clock signal, or a multiple thereof, may be used for signal S1 and inverted for signal S2. Synchronous operation limits the detrimental effects of interference, such as EMI and RFI, caused by non-synchronous operation. It should also be noted that where the operating frequency of the signals S1 and S2 exceeds the operating frequency of the buck regulator by a factor of five or greater, synchronization is typically not needed. Those skilled in the art will readily see how signals S1 and S2 can be produced through a variety of ways to achieve this objective.

The secondary winding 42, which is coupled to primary winding 41, is positioned in series with the gas discharge lamp 60. It is desirable to introduce some capacitance in series with the lamp 60 and secondary winding 42 in order to provide direct current blocking for the lamp 60. This capacitance is represented by a capacitor 47, but could be omitted or could also include alternate configurations of circuit design available to create a capacitance in the absence of a discrete, separate component, as is known in the art. By way of example, and not limitation, such configurations may include alternatives such as placing two conductors near each other without touching. The capacitor 47 is preferable for applications involving fluorescent lamps, but is not required and may otherwise be omitted. This design may include other circuitry as desired for the particular application; for example, the invention may include one or more heaters, which are generally omitted for use with cold cathode fluorescent lamps.

For ease of description, this embodiment is shown in a configuration that supports single-phase applications. Those skilled in the art will recognize the invention's ready adaptability to multi-phase operation, with minor changes in individual components that are well known. For example, the transformer 46 is described above as comprising a primary winding 41 with a center tap 45. For three-phase operation, the transformer 46 could be implemented with three primary windings, such as a WYE transformer, with a center tap common to the three primary windings. Accordingly, it is intended that elements such as windings, power switches, or other circuit components be construed as including all known modifications to enable multi-phase operation. That is, with respect to the above example, primary winding 41 should be construed as a primary winding or windings appropriate for the number of phases of the application. It should also be recognized that, using such a multiphase configuration, the ballast can provide multiphase power to one or more multiphase lamps, or each phase of the multiphase configuration can provide single-phase power to one or more single-phase lamps.

Similarly, the above examples are shown with a single lamp 60, which is intended to be construed as one or more gas discharge lamps, with such minor adaptations as are known in the art. Moreover, the term gas discharge lamp is intended to encompass a variety of gas discharge lamps known in the art, which includes, and should not be limited to, fluorescent lamps, HID lamps, metal halide type lamps, and high or low pressure sodium lamps. The power switches 43 and 44, the current switch 31, and the discharge switch 32 may be MOSFET, JFET, IGBT, bipolar transistors, GTO, or other equivalents. In some embodiments, a power conversion stage may be included with a basic Royer circuit in order to regulate lamp power from line voltage changes. For the purposes of this specification and the appended claims, the terms "connected" or "joined" mean that there exists a conductive path, which may include elements that are not explicitly recited.

In operation, the electronic ballast described above is designed to produce a more efficient conversion of input energy into light. By applying a square wave constant current to the lamp, the ballast minimizes de-ionization and improves efficiency.

With reference to FIG. 3, the square wave is formed when power switches 43 and 44 alternatively switch, conducting against the impedance of inductor 34, into center tap 45, and across the respective portions of primary winding 41. The voltage of the square wave is a linear function of the voltage at inductor 34. Signals S1 and S2 control power switches 43 and 44, and may be derived from the PWM 33 clock. Selection of the values of the individual components of the electronic ballast should preferably produce a no load voltage for the current equal to the strike voltage of the lamp 60. An induced square wave current is produced in secondary winding 42 by its coupling with primary winding 41. The signals S1 and S2 are controlled to produce a square wave, preferably at a frequency between 2 KHz and 120 KHz, although higher or lower frequencies may be used, such as 400 KHz. A small, high-voltage capacitor 47 may optionally be positioned in series with the lamp 60. Optional capacitor 47 is employed, for example, to perform direct current blocking to resist lamp mercury migration.

As discussed above, the current source block 30 comprises a pulse-width modulated synchronous buck converter. This PWM 33 comprises clock and timer logic. The timer logic shuts off the current at current switch 31 when an open is sensed at the lamp 60. That is, the timer logic of the PWM 33 tests for the presence of a load across the secondary winding 42 of the transformer 46 by sensing the current flowing at the current sense block 50, i.e., the voltage at current sense resistor 52 (or a current from a current sensing transformer). If no load is detected, the timer stops the power generation for a period of time before testing again.

During initial start-up, the PWM 33 controls current switch 31 to provide 400–650 volts to the primary winding 41 of the transformer sudden flow of energy produces a narrow pulse of voltage at the transformer 46 that is coupled to the secondary winding 42 before the core of the transformer saturates. The result is a starting voltage at the secondary winding 42 of about 3 kV, which ionizes the lamp 60. Higher or lower start voltages may be produced. Once the lamp 60 is ionized, the lamp 60 requires much less voltage to continue to operate. For example, subsequent normal operation can be achieved with a square wave at a low peak-to-peak voltage of less than 80 volts. This lower operating voltage provides increased efficiency resulting from the ability to use lower voltage power switches 43 and 44, which are generally more efficient.

After the initial pulse, the PWM 33 receives current sense information from the current sense block 50. In FIG. 3, the current sense information is shown as a voltage corresponding to the current flowing through resistor 52. As can be appreciated, however, there are many other techniques known in the art that can be used to obtain current sense information, such as the current sensing transformer alternative mentioned above. The PWM 33 controls the current switch 33 and discharge switch 32 in a complementary manner to adjust the current flow through the inductor 34 to the center tap 45 of the primary winding 41 so the current drops to a level corresponding to the desired peak-to-peak voltage at the lamp 60, which also allows the transformer core to operate unsaturated. That is, the current switch 33 and discharge switch 32 are switched on one at a time, and never at the same time, at appropriate intervals and durations to adjust a constant current flow to the transformer 46 through the inductor 34. The preferred normal operating condition is a constant current corresponding to a square wave output to the lamp having a peak-to-peak voltage approximately equal to the normal operating voltage of the lamp.

Figure 4:
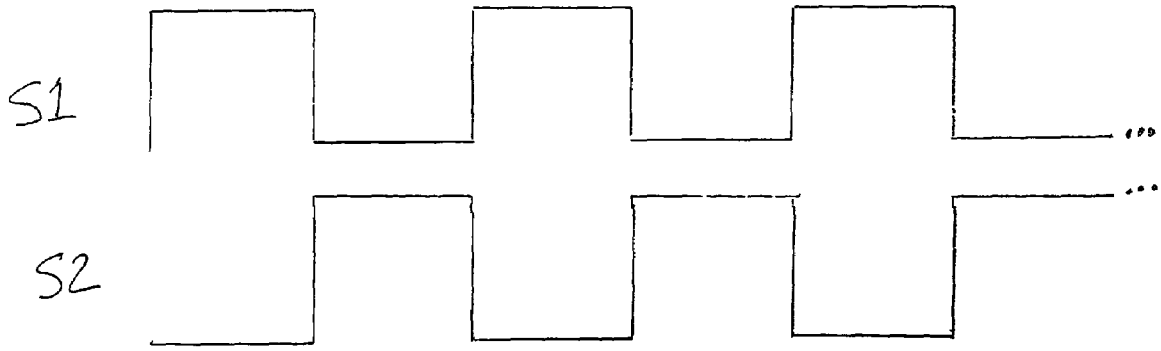
FIG. 4 illustrates an exemplary representation of power switch control signals.

The current is received at the center tap 45 of the primary winding 41 of the transformer 46. The power switches 43 and 44 are controlled, via signals S1 and S2, to produce complementary duty cycles of current on each half 41A and 41B of the primary winding 41 of preferably 48–50%. That is, the power switches 43 and 44 are alternately switched on and off at appropriate intervals and durations to produce a square wave at the secondary winding 42, thus producing a constant square wave at the lamp 60. FIG. 4 illustrates an exemplary representation of signals S1 and S2. As discussed above, signals S1 and S2 may be derived from clock logic in the PWM 33 to provide synchronization to the current source block.

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

What is claimed is:

1. An electronic ballast for a gas discharge lamp, comprising:

an adjustable constant current source circuit adapted to convert a direct current input to provide an initial start current and a variably controlled constant current, wherein said adjustable constant current source comprises a synchronous buck rectifier;

a coupling transformer circuit connected to the adjustable constant current source and adapted to couple the initial start current to the gas discharge lamp to provide a corresponding start voltage approximately equal to a strike voltage of the gas discharge lamp and to convert the variably controlled constant current to a square wave current to power the gas discharge lamp thereafter; and a current sense circuit adapted to sense an operating current at the coupling transformer and to provide corresponding current sense information to the adjustable constant current source, wherein said current sense information is used to vary the variably controlled constant current.

2. The electronic ballast of claim 1, further comprising a rectifier adapted to convert alternating current into a direct current and a filter adapted to remove any alternating current ripple from said direct current to provide the direct current input.

3. The electronic ballast of claim 1, wherein the current sense circuit comprises a resistor configured to convert the variably controlled constant current flowing through a primary winding of a transformer in the coupling transformer circuit to a corresponding voltage and to provide the corresponding voltage to the adjustable constant current source as the current sense information.

4. The electronic ballast of claim 1, wherein the current sense circuit comprises a transformer configured to sense the variably controlled constant current flowing through a primary winding of a transformer in the coupling transformer circuit to provide the current sense information.

5. The electronic ballast of claim 1, wherein said adjustable constant current source comprises a synchronous buck regulator.

6. The electronic ballast of claim 1, wherein the adjustable constant current source circuit comprises a current switch, a discharge switch, an inductor and a pulse-width modulator, configured such that: the pulse-width modulator controls the current switch to vary the variably controlled constant current, and the discharge switch to discharge any superfluous current to ground, according to the current sense information; and the inductor is adapted to limit a rate of change in the variably controlled constant current and provide the variably controlled constant current to the coupling transformer circuit.

7. The electronic ballast of claim 6, wherein the pulse-width modulator further comprises timer logic that stops the power generation for a period of time when conditions indicate that no load is across a secondary winding of a transformer in the coupling transformer circuit.

8. The electronic ballast of claim 1, wherein the adjustable constant current source circuit comprises a current switch, a diode, an inductor and a pulse-width modulator, configured such that: the pulse-width modulator controls the current switch to vary the variably controlled constant current according to the current sense information; the diode discharges any superfluous current to ground; and the inductor is adapted to limit a rate of change in the variably controlled constant current and provide the variably controlled constant current to the coupling transformer circuit.

9. The electronic ballast of claim 8, wherein the pulse-width modulator further comprises timer logic that stops the power generation for a period of time when conditions indicate that no load is across a secondary winding of a transformer in the coupling transformer circuit.

10. The electronic ballast of claim 1, wherein the coupling transformer circuit comprises a center-tapped transformer and two power switches, and is configured such that: the output of the adjustable constant current source is applied to a center tap of a primary winding of the center-tapped transformer; the two power switches are arranged to control current flow from the center tap through each respective portion of the primary winding of the center-tapped transformer; and a secondary winding of said the center-tapped transformer is coupled to said primary winding, wherein said secondary winding is in series with said gas discharge lamp.

11. The electronic ballast of claim 10, further comprising a capacitor positioned in series with the secondary of the center-tapped transformer.

12. The electronic ballast of claim 10, wherein the two power switches are arranged to control current flow from the center tap through each respective portion of the primary winding of the center-tapped transformer under the control of a clock logic of the pulse-width modulator.

13. A method for driving a gas discharge lamp with an electronic ballast, comprising:

converting a direct current input to provide an initial start current and a variably controlled constant current;

coupling the initial start current to the gas discharge lamp to provide a corresponding start voltage approximately equal to a strike voltage of the gas discharge lamp;

converting the variably controlled constant current to a square wave current to power the gas discharge lamp thereafter; and sensing an operating current to provide corresponding current sense information used to vary the variably controlled constant current.

14. The method of claim 13, further comprising:

converting an alternating current into a direct current; and removing any alternating current ripple from said direct current to provide the direct current input.

15. The method of claim 13, wherein converting the variably controlled constant current to a square wave comprises:

applying the output of the adjustable constant current source to a center tap of a primary winding of a center-tapped transformer;

controlling a current flow from the center tap through each respective portion of the primary winding of the center-tapped transformer; and coupling a secondary winding of said the center-tapped transformer to said primary winding, wherein said secondary winding is in series with said gas discharge lamp.

16. The method of claim 13, wherein converting a direct current input comprises: controlling a current switch to vary the variably controlled constant current, and a discharge switch to discharge any superfluous current to ground, according to the current sense information; and limiting a rate of change in the variably controlled constant current.

17. The method of claim 13, wherein converting a direct current input comprises: controlling a current switch to vary the variably controlled constant current according to the current sense information; discharging superfluous current to ground; and limiting a rate of change in the variably controlled constant current.

18. The method of claim 13, further comprising: stopping the power generation for a period of time when conditions indicate that no gas-discharge lamp is present or the gas-discharge lamp is not conducting current.

* * * * *